US009532606B2

(12) United States Patent
Yoshimura

(10) Patent No.: US 9,532,606 B2
(45) Date of Patent: Jan. 3, 2017

(54) SOCK

(71) Applicant: Cooma Co., Ltd., Matsubara (JP)

(72) Inventor: Noriyoshi Yoshimura, Matsubara (JP)

(73) Assignee: Cooma Co., Ltd., Osaka (JP)

( * ) Notice: Subject to any disclaimer, the term of this patent is extended or adjusted under 35 U.S.C. 154(b) by 7 days.

(21) Appl. No.: 14/122,419

(22) PCT Filed: Jun. 28, 2013

(86) PCT No.: PCT/JP2013/067922
§ 371 (c)(1),
(2) Date: Nov. 26, 2013

(87) PCT Pub. No.: WO2014/122809
PCT Pub. Date: Aug. 14, 2014

(65) Prior Publication Data

US 2014/0338403 A1 Nov. 20, 2014

(30) Foreign Application Priority Data

Feb. 9, 2013 (JP) ..... 2013-023903

(51) Int. Cl.
*A41B 11/00* (2006.01)
*D04B 11/06* (2006.01)
(Continued)

(52) U.S. Cl.
CPC ..... *A41B 11/003* (2013.01); *D04B 1/108* (2013.01); *D04B 1/22* (2013.01); *D04B 1/26* (2013.01);
(Continued)

(58) Field of Classification Search
CPC ..... A43B 17/003; A41B 11/00; D04B 1/26; D04B 1/108; D04B 1/22; D04B 1/225; D04B 7/10; D04B 9/20; D04B 11/06
(Continued)

(56) References Cited

U.S. PATENT DOCUMENTS 234,074 A * 11/1880 Scott ..... 66/187
482,095 A * 9/1892 McClurg ..... 66/187
(Continued)

FOREIGN PATENT DOCUMENTS

JP 1121703 A 1/1999
JP 2002509202 A 3/2002
(Continued)

*Primary Examiner* — Danny Worrell
*Assistant Examiner* — Katharine Gracz
(74) *Attorney, Agent, or Firm* — The Webb Law Firm

(57) ABSTRACT

A sock includes a foot section and a toe section both formed of knitted fabric, the toe section being provided in the form of a bag having a predetermined shape by mutual joining of circumferential edges of the knitted fabric. A knitted portion of the fabric covers a lateral face of the vicinity of a base of the toe section. A big-toe side end edge of fabric covers at least one of the sole portion and instep portion of the toe section and wraps around to the other on the toe base side and a big-toe side join line joining them is located within the plane of the other. The toe section consists of a big toe bag and a four-toe bag. The big-toe bag, which cover the base of the body-center side lateral face of the big toe includes a knitted portion of a knitted fabric is present.

4 Claims, 9 Drawing Sheets

(51) Int. Cl.

| | |
|---|---|
| ***D04B 7/10*** | (2006.01) |
| ***D04B 9/20*** | (2006.01) |
| ***D04B 1/22*** | (2006.01) |
| ***D04B 1/10*** | (2006.01) |
| ***D04B 1/26*** | (2006.01) |

(52) U.S. Cl.
CPC . *D04B 7/10* (2013.01); *D04B 9/20* (2013.01); *D04B 11/06* (2013.01); *A41B 11/00* (2013.01)

(58) Field of Classification Search
USPC ..... 66/185, 186, 187, 189, 30, 37, 39, 46, 51,66/76, 67
See application file for complete search history.

(56) References Cited

U.S. PATENT DOCUMENTS

| | | | | |
|---|---|---|---|---|
| 3,015,942 | A * | 1/1962 | Getaz | 66/186 |
| 6,000,247 | A | 12/1999 | Takeda et al. | |
| 6,481,245 | B1 * | 11/2002 | Kalde | 66/178 R |
| 7,437,896 | B2 | 10/2008 | Hirao et al. | |
| 2003/0182974 | A1 * | 10/2003 | Ando | 66/8 |
| 2005/0235702 | A1 * | 10/2005 | Takeda et al. | 66/186 |
| 2008/0034802 | A1 * | 2/2008 | Hirao et al. | 66/8 |
| 2013/0031937 | A1 * | 2/2013 | Beckler et al. | 66/51 |

FOREIGN PATENT DOCUMENTS

| | | | |
|---|---|---|---|
| JP | 2004218131 | A | 8/2004 |
| JP | 2005307370 | A | 11/2005 |
| JP | 3780354 | B2 | 3/2006 |
| JP | 2008303475 | A | 12/2008 |

* cited by examiner

SOCK

TECHNICAL FIELD

The present invention relates to a sock including a foot section and a toe section both formed of knitted fabric, the toe section being provided in the form of a bag having a predetermined shape by mutual joining of circumferential edges of the knitted fabric.

BACKGROUND ART

The original function of a sock (or a pair of socks) is to prevent abrasion damage that is caused due to direct contact between the inside face of the shoe and the foot when the shoe is worn.

Therefore, in order to prevent abrasion of the foot with a strong force that occurs when relative movement occurs between the sock and the foot, the sock was formed conventionally of a soft fabric. And, as a typical fabric for such use, knitted fabric is commonly employed.

On the other hand, if there occurs e.g. excess of the fabric due to mismatch between the sock and the foot, when the shoe is worn, the excess fabric will exert pressure to the foot locally, thus giving unnatural feel.

Therefore, in order to obtain a shape that maximally matches the foot shape, there has long been employed a construction wherein a bag-like toe section or heel portion is joined to a tubular foot section.

Meanwhile, in the relationship between a shoe and a foot, not only agreement of length, but also agreement of lateral width is important. Regarding the issue of agreement or non-agreement of lateral width, it is said that a lateral width is suitable if it provides contact between the lateral face of the big toe and the inner face of the shoe, but which causes no compression therebetween.

That is, the base of the big toe and the lateral face adjacent thereto are portions which are to be constantly placed in contact with the shoe via the sock. In the case of the conventional socks disclosed in Patent Documents 1 and 2, at this portion, there exist at least a portion of circumferential edge of the knitted fabric and a join line to which this circumferential edge portion is joined.

Such join line lacks the elasticity inherent in the knitted fabric. Hence, in spite of use of knitted fabric having flexibility, there was possibility of giving the big toe base portion a damage such as an abrasion damage. Especially, when a violent movement such as a sporting activity is effected, such damage would appear more conspicuously.

PRIOR ART DOCUMENTS

Patent Documents

Patent Document 1: Japanese Patent National Transfer Application No. 2002-509202

Patent Document 2: Japanese Patent No. 3780354

SUMMARY OF THE INVENTION

Object to be Achieved by Invention

The object of the present invention is to provide a sock capable of providing protection to the vicinity of the big toe base portion, as well as to the other portion.

Means to Achieve Object

A sock according to Present Invention 1 is characterized in that a knitted portion of the fabric is present at a portion covering a lateral face of the vicinity of a base of a toe section.

Here, the toe section includes a stitch-number decreasing area where an area knitted by reciprocal knitting is progressively decreased and a stitch-number increasing area where an area knitted by reciprocal knitting is progressively increased. In the toe section, the stitch-number decreasing area is provided at a position adjacent the foot section. And, the stitch-number decreasing area includes a sole fabric extending across and between a sole side and an instep side and a sole leading end fabric provided only on the sole side. An end edge of a wraparound portion of the sole fabric wrapping around to the instep side extends to a lateral dividing line which divides between the instep side and the sole side of the knitted fabric; and an end edge of the sole leading end fabric connected to the end edge of the wraparound portion intersects the lateral dividing line and extends beyond the position thereof.

In the above, in the context of the present invention, the language "end edge of a wraparound portion . . . extends to a lateral dividing line" means that as seen geometrically in a development, a line segment formed by the end edge of the wraparound portion extends to the lateral dividing line. In actual knitting, the end edge of the wraparound portion and the sole leading end fabric can be knitted in a continuous manner.

Here, in the context of the present invention, in the language "end edge of the sole leading end fabric connected to the end edge of the wraparound portion", the term "connected" can include direct connection of the end edge of the sole leading end fabric by being continuously knitted with the end edge of the sole fabric as well as indirect connection between the end edge of the sole fabric and the end edge of the wraparound portion in the sole leading end fabric through formation of a ring-like fabric portion between the end edge of the sole fabric and the end edge of the wraparound portion in the sole leading end fabric.

Present Invention 2 is characterized, in the sock of Present Invention 1, in that a big-toe side end edge of the fabric covering one of the sole portion and the instep portion of the toe section extends into the other of the sole portion and the instep portion of the toe section and a big-toe side join line joining these two portions is located within the plane (rear face) of the other.

Present Invention 3 is characterized, in the sock of Present Invention 1, in that the toe section consists of a big toe bag accommodating the big toe and a four-toe bag accommodating the other toes, and in the big-toe bag, at a portion thereof covering the base of body-center side lateral face of the big toe, a knitted portion of a knitted fabric is present.

Present Invention 4 is characterized, in the sock of Present Invention 3, in that a body-center side lateral end edge of the fabric covering one of the sole portion and the instep portion of the big-toe bag extends into the other on the side of the toe base side, and a big-toe side join line joining these two portions is located within the plane (rear face) of the other.

Effect of the Invention

According to Present Invention 1, the body-center side lateral face of the big-toe base and its vicinity are covered by an intermediate portion (a portion that provides the flexibility and the elasticity inherent in the knitted fabric) of the knitted fabric. Hence, it has become possible to provide the foot protecting function at this portion, too.

As a result, even in a violent movement, damage which would otherwise occur at the big-toe base and its vicinity can be lessened. Further, with the arrangement that an end edge of a wraparound portion of the sole fabric wrapping around to the instep side extends to a lateral dividing line which divides between the instep side and the sole side of the knitted fabric; and an end edge of the sole leading end fabric connected to the end edge of the wraparound portion intersects the lateral dividing line and extends beyond the position thereof, thus being joined to one end edge of the sole leading end fabric, the end edge of the wraparound portion of the sole fabric wrapping around to the instep side can be provided as a portion which is sewn after the knitting or an edge which is to be connected during the knitting and can be provided as an edge connected during the knitting of the end edge of the sole leading end fabric. Hence, the problem of presence of a sewing line in the body-center side lateral face of the big toe and its vicinity can be solved.

According to Present Invention 2, in addition to the effect according to Present Invention 1, the sewing line which was previously present at the portion where the foot section and the toe section are continuously present is now non-existent on the big-toe side. As a result, an inadvertent hooking incidence which occurs when the big toe is inserted into the toe section has been eliminated.

According to Present Invention 3, similar effect to Present Invention 1 can be achieved in a "tabi" sock also.

According to Present Invention 4, in addition to achievement of the effect similar to Present Invention 3, the sewing line which was previously present in the foot section and the toe section from the foot section to the toe section is now non-existent on the body center side. As a result, the inadvertent hooking incidence which occurs when the big toe is inserted into the narrow big toe bag has been eliminated.

Moreover, as it is possible to form a big-toe bag narrower than the conventional sock for "tabi", excess of fabric in the width direction which was formed in the big toe bag has been eliminated, so that a sock providing snugness for the big toe also can now be provided.

MODES OF EMBODYING THE INVENTION

Figure 1:
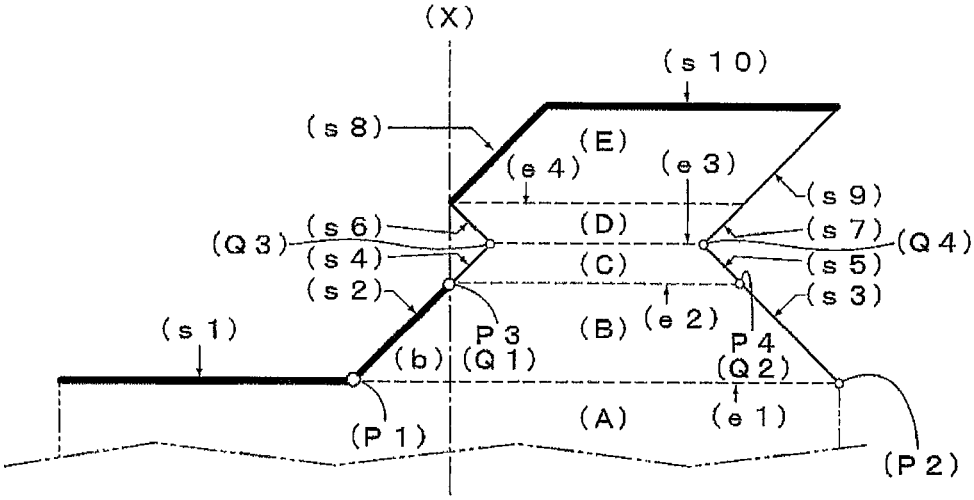
FIG. 1 is a development showing a toe section of a sock according to Example 1.

The present invention comprises a sock capable of protecting bases of the big toe and small toe and the vicinities thereof with the flexibility inherent in a knitted fabric.

The term "a sock" in the context of the present invention refers to a sock having a bag-like toe section (2) at the leading end of a foot section (1), the term being understood to include not only a stocking or a sock having a leg section and a heel section, but also a foot cover having no leg section or a toe cover having neither leg section nor heel section.

Further, the toe section can be applied to a sock for a Japanese "tabi" (a shoe or sock having a big-toe separation) or to a sock having five bags for accommodating the respective toes separately.

Further, as to the constructions of the foot section, the heel section and the leg section also, any of conventional ones can be applied.

Also, as to the kind and thickness of knitting threads to be used, any can be employed if they are usable for sock knitting.

In addition to the above, various known techniques can be used also as long as such techniques do not hinder the spirit of the present invention.

In an embodiment to be described next, there will be shown a knitting method by a circular knitting machine. However, the invention does not exclude use of any other knitting machine suitable for sock knitting.

Further, in the disclosed example, notations are provided from the sole side. But, it is also possible to knit from the instep side and in such case, the figure will be one left-to-right reversal of the development. In either case, knitting of wraparound portion toward the little toe side is also possible.

The developments in the accompanying drawings show patterns at the time of knitting. Further, the plane views and the bottom views show the skeleton shape of a sock knitted based on the developments.

In the actual sock, angular portions in the plane views and bottom views will be formed round and the shape of the fabric too will be deformed due to stress balance resulting from sewing or joining. The degree of these deformations will differ, depending on differences of threads used or combinations thereof or difference of knitting structure of the knitting.

However, as such deformations will be readily expected by those skilled in the art, it should be extremely easy for those skilled in the art to recognize the skeleton shape from an actual sock, with taking into consideration influences from such deformations.

In the following, there will be explained examples of the present invention with reference to the accompanying drawings. In each drawing, of lines shown, solid lines represent the outer contour lines of the sock or the circumferential edges of the fabric, chain lines represent borderlines between fabrics to be knitted continuously, narrow solid lines represent circumferential edges of the fabrics which are to be joined to each other during knitting, bold solid lines represent circumferential edges of the fabric which are to be sewn to each other after the knitting, respectively.

The one-dot chain line (X) represents the centerline of the portion of the sock covering the big toe which line is in contact with the body-center side lateral face. The one-dot chain line (Y) represents a centerline in contact with the big-toe side lateral face of the second toe, and in the developments, the right side from the centerline (X) will represent the sole side of the foot section (1) and the left side will represent the instep side, respectively. A sole fabric end line (Z) represents the border between the sole side lateral face and the instep side lateral face. Here, the centerline (X) corresponds to what is defined as "lateral dividing line" in the context of the present invention. Also, the two-dot chain lines present on the left and right opposed ends in the developments represent cutting lines for development and these lines are present at one same portion before the cutting.

In the developments, the areas (e.g. (B) and (C) in FIG. 1) whose width (the length in the left-right direction in the drawings) in the direction from the lower side to the upper side in the drawings progressively decreases correspond to the "stitch-number decreasing area"; and the area (e.g. (D) in FIG. 1) whose width in the direction from the lower side to the upper side in the drawings corresponds to the "stitch-number increasing area" in the context of the present invention respectively. Further, in the developments, the knitted area (e.g. (E) in FIG. 1) whose width is formed constant with decrease of one of the left and right side and increase of the other side and having parallelogram-shaped is referred to as the "stitch-number constant area".

Incidentally, in the following discussion, any one of the upper bottom, lower bottom and left and right sides of the trapezoidal or parallelogram shape will be referred to as "circumferential edge". Further, in the present invention, of these circumferential edges, the circumferential edge of either left or right side of the trapezoidal fabric area will be referred to as an "end edge".

Example 1

In the instant embodiment, with reference to FIG. 1, FIG. 2 and FIG. 3, there will be explained an example of a toe section (2) of an ordinary sock configured to accommodate five toes in a single bag altogether.

A tubular fabric (A) is a fabric knitted in a form of a seamless tube by forward knitting and forms a foot section (1) of the sock.

In the instant embodiment, in (B) through (E) together constituting the toe section (2), at a position adjacent the tubular fabric (A) constituting the foot section (1), there are disposed, in continuation, a sole fabric (B) and a sole leading end fabric (C) which are stitch-decreasing areas. The sole fabric (B) extends between and across the sole side and the instep side and the sole leading end fabric (C) is disposed only on the sole side. In the following, of the sole fabric (B), a portion thereof extending to the instep side will be referred to as a "wraparound portion (b)".

According to a characterizing feature of the present invention, the circumferential edge (s2) of the wraparound portion (b) in the sole fabric (B) is disposed to extend to reach the centerline (X) and to be joined to one circumferential edge (s4) of the sole leading end fabric (C).

In the above, the circumferential edges (s2) and (s4) correspond to what is defined as the "end edge" in the context of the present invention.

More particularly, the one circumferential edge (s2) of the sole fabric (B) is formed as a straight line that joins an end point (P1) located on the instep side than the centerline (X) with an end point (P3) on this centerline (X). Also, the other circumferential edge (s3) is formed as a straight line that joins an end point (P2) located on the sole side of the tubular fabric (A) with an end point (P4) located on the instep side than the end point (P2).

Further, the sole leading end fabric (C) is knitted such that the end points (P3) and (P4) of the sole fabric (B) form end points (Q1), (Q2) on the side of the toe base side and with extension of the circumferential edge (s2), the end point (Q3) is located more on the sole side than the end point (Q1), and the end point (Q4) is located more on the instep side than the end point (Q2).

Next, a method of knitting the sole fabric (B) through the instep fabric (E), subsequent to the knitting of the tubular fabric (A) will be explained.

From a knitting end line (e1) of the tubular fabric (A), the sole fabric (B) having a right-to-left symmetric trapezoidal shape is knitted by reciprocal knitting.

The sole fabric (B) includes the wraparound portion (b) for wrapping around to the instep side. For this reason, knitting of the sole fabric (B) is started with a width greater by the amount required for the wraparound beyond the centerline (X).

Then, at the position where its left circumferential edge (s2) intersects the centerline (X), knitting of the sole fabric (B) is ended and then, from its knitting end line (e2), the sole leading end fabric (C) is knitted in a similarly inclined trapezoidal shape to a knitting end line (e3).

Subsequently, from this knitting end line (e3), the top leading end fabric (D) having a vertically reversed trapezoidal shape relative to the sole leading end fabric (C) is knitted to its knitting end line (e4).

Further, from the knitting end line (e4), the instep fabric (E) having a parallelogram shape inclined toward the little toe side is knitted to complete this knitting process.

During the above-described knitting process, the left and right circumferential edges (s4) and (s6), (s5) and (s7), (s3) and (s9) are joined to each other, thereby to form join lines (s4-6), (s5-7) and (s3-9), respectively, thus forming the bag-like toe section (2).

With the above-described knitting process, the opening formed between the toe section (2) and the foot section (1) and having the circumferential edges (s1), (s2), (s8) and (s10) as the opening edges is closed with sewing (s1) and (s10), (s2) and (s8) respectively each other to form sewing lines (s1-10) and (s2-8), thus completing the sock.

In the above, the circumferential edge (s2) is formed parallel with the one circumferential edge (s8) of the instep fabric (E) and the circumferential edge (s3) is disposed to be in agreement with the other circumferential edge (s9) of the instep fabric (E) when sewn therewith. Further, an arrangement is made such that the sum of the areas of the wraparound portion (b) and the instep fabric (E) is equal to the difference obtained by subtracting the area of the wraparound portion (b) from the area of the sole fabric (B). That is, as shown in FIG. 2, the combined width of the wraparound portion (b) and the instep fabric (E) is made equal to the width of the area of the sole fabric (B) minus the area of the wraparound portion (b).

Figure 2:
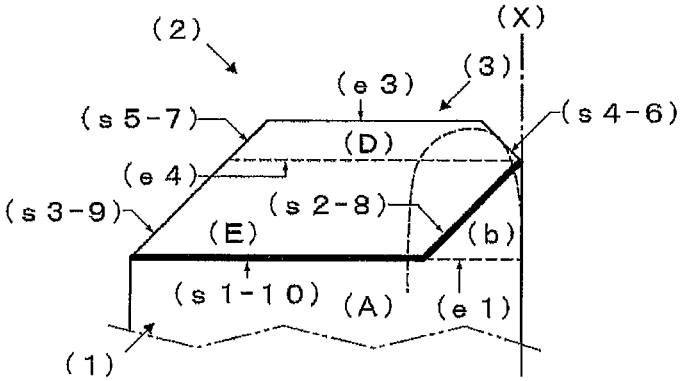
FIG. 2 is a plane view showing the instep side of the toe section based on the development of FIG. 1.

With the above, as shown in FIG. 2, the body-center side lateral face of the sock covering the big toe is formed straight along the centerline (X).

Further, the inclinations of the circumferential edge (s4) and the circumferential edge (s6) in FIG. 1 are determined such that these edges when sewn together lie along the leading end of the big toe.

With the above, there is obtained a sock having snugly feel along the lateral face and the leading end of the big toe.

As described above, as shown in FIG. 2 and FIG. 3, there has been obtained a sock wherein the base of the body-center side lateral face of the big toe and its vicinity are covered by the knitted fabric having continuous wales formed by the wraparound portion (b), the tubular fabric (A) and the sole fabric (B), with absence of any circumferential edges of the fabric.

Absence of any join lines or sewing lines formed for the sake of integration with other fabric at the base of the body-center side lateral face of the big toe and its vicinity means that this sock is capable of covering these big toe portions with the flexibility inherent in the knitted fabric, thus not causing any abrasion damage which would occur conventionally due to reduction in the flexibility due to the presence of the join lines and sewing lines. Further, at the portion extending beyond the section (B)-(E), the sock has a same construction as the conventional toe section construction. Hence, knitting of the toe section can be done with varying the shape of the toe section, in any known manner.

Example 2

Next, with reference to FIG. 4, FIG. 5 and FIG. 6, there will be explained an example in which a spacing is provided between the instep portion and the sole portion, in the arrangement of Example 1 above. In this example too, the circumferential edges (s2) and (s4) corresponds to what is defined as the "end edge" in the context of the present invention.

In this example, a ring-like fabric (F) knitted by forward knitting is interposed between the sole leading end fabric (C) and the instep leading end fabric (D).

The course number (the spacing between (e3*a*) and (e3*b*)) of this ring-like fabric (F) can be set to any number of 2 courses or more, but a number corresponding to the thickness of the little finger or a smaller number is appropriate for effectively avoiding generation of excess fabric on the little finger side.

With this ring-like fabric (F), the circumferential edges (s4) and (s6), (s5) and (s7), and (s3) and (s9) become join lines (s4-11) and (s6-13), (s5-12) and (s7-14), (s3-12) and (s9-14), with the interposition of this ring-like fabric (F), rather than being directed joined to each other like (s4-6), (s5-7) and (s3-9) in Example 1.

As the wales formed by knitting and the pivotal ends are joined to each other, there occurs no significant hindrance to the elasticity of these join line. Consequently, there is obtained elasticity similar to the original elasticity of knitted fabric (see Patent Document 2).

Further, due to the interposition of this ring-like fabric (F), each join line in this example has higher possibility of coming into contact with a portion displaced up/down to the most prominent portion at the vertical center of the toes. Therefore, it has become possible to reduce the contact pressure with these toe surfaces as well.

With the above-described arrangements, it has become possible to provide soft touch also in the contact with the little toe lateral face, the contact with the leading end lateral face of the big toe, the soft touch providing being substantially same as the elasticity inherent in knitted fabric.

Furthermore, at the portion in contact with the leading end of toe also, certain thickness can be provided by the ring-like fabric (F), so that it has become possible to alleviate vertical pressurization of the toe.

Also, of the circumferential edges to be sewn, (s13) is formed as a straight line and as the circumferential edges (s8),(s10) are sewn thereto, sewing lines (s8-13) and (s10-13) are formed. Therefore, the opening can be closed with the straight simple sewing work.

The other respects are same as Example 1 described above, so it is needless to say that this example too has the same effect as Example 1.

Figure 3:
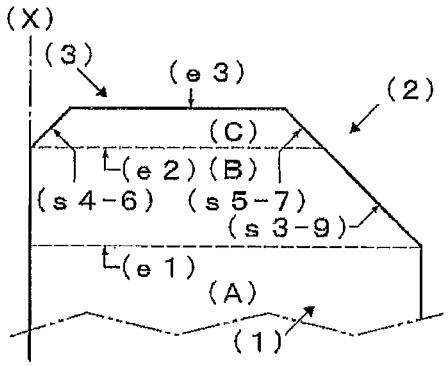
FIG. 3 is a bottom view showing the sole side of the toe section based on the development of FIG. 1.
Figure 4:
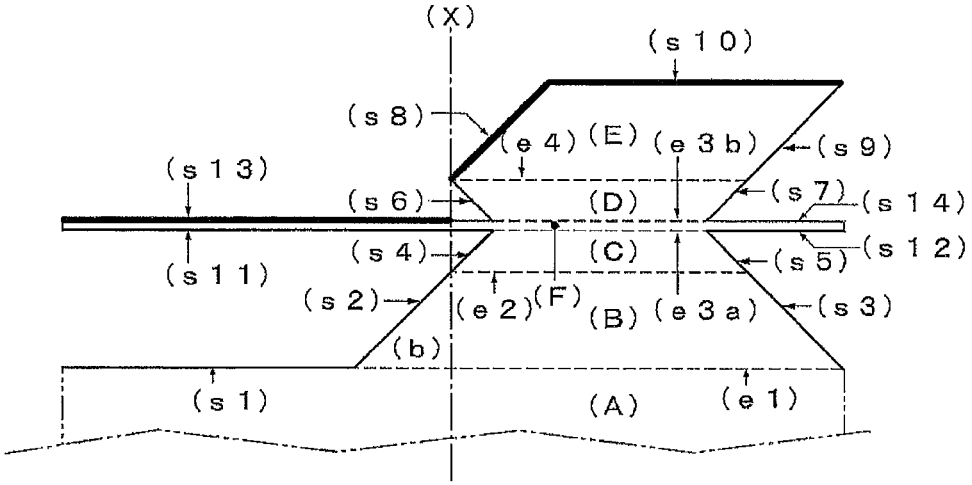
FIG. 4 is a development showing a toe section of a sock according to Example 2.
Figure 5:
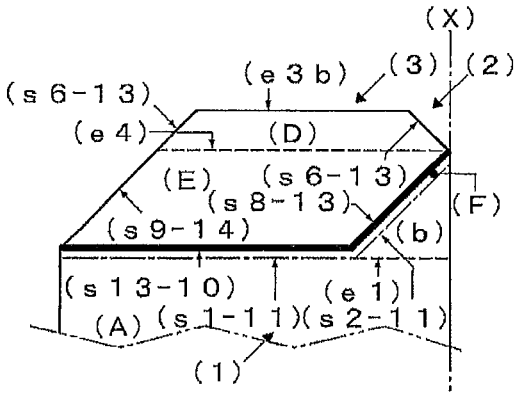
FIG. 5 is a plane view showing the instep side of the toe section based on the development of FIG. 4.
Figure 6:
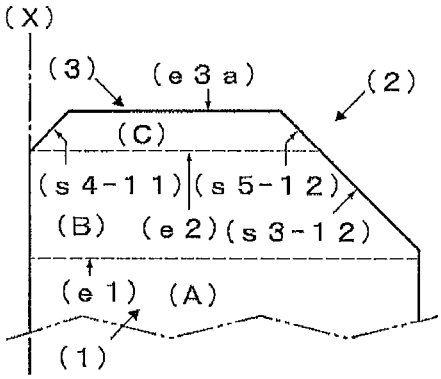
FIG. 6 is a bottom view showing the sole side of the toe section based on the development of FIG. 4.

Further, respecting the same arrangements as Example 1, same reference marks as those in FIG. 1, FIG. 2 and FIG. 3 are provided in FIG. 4, FIG. 5 and FIG. 6 and detailed discussion thereof will be omitted.

Other Embodiment

In the example explained with reference to FIG. 4, FIG. 5 and FIG. 6, regarding the sole fabric (B), the sole leading end fabric (C), the ring-like fabric (F), the instep leading end fabric (D) and the instep fabric (E) formed as the stitch-number decreasing areas can employ the arrangement of Example 2. Specifically, by displacing the knitting start position of the instep leading end fabric (D) in the direction away from the centerline (X) thereby to decrease the knitting starting number of stitches of the instep fabric (E) by the displaced number of stitches, thereby to cause a knitting start point of s3 to agree with the knitting end point of s9. With this, there is generated shortage of fabric between the knitting end line of the instep leading end fabric (E) and the knitting end line of the ring-like fabric (F). Then, as these two lines are sewn together, the toe section can be deformed into the shape of foot. With the above-described arrangement, as a result of the deformation, the toe section can be formed in a three-dimensional shape raised toward the instep side adjacent the big toe.

Example 3

Figure 7:
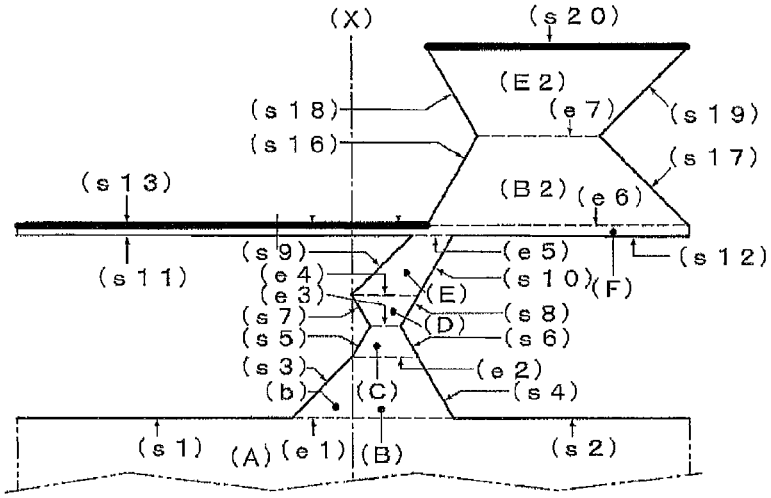
FIG. 7 is a development showing a toe section of a sock according to Example 3.
Figure 8:
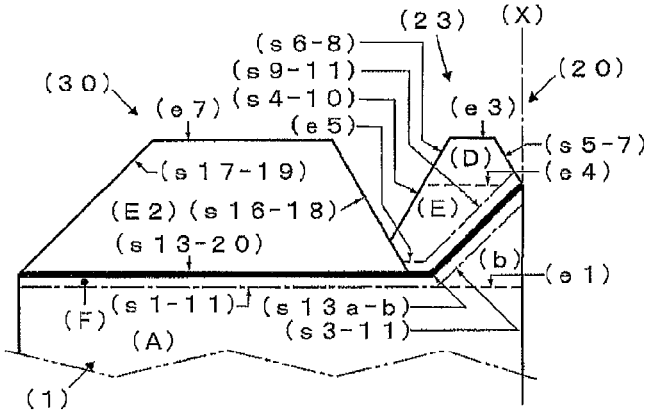
FIG. 8 is an enlarged plane view showing the instep side of the toe section based on the development of FIG. 7.
Figure 9:
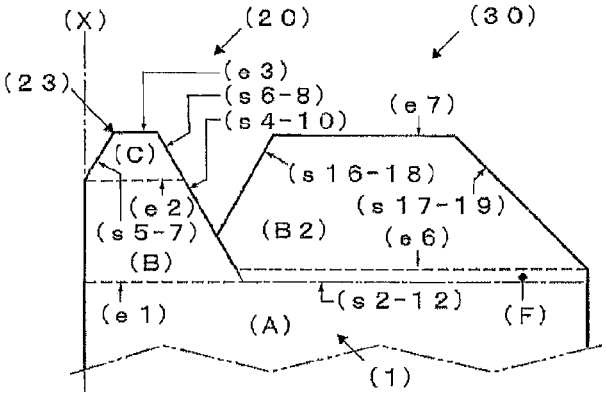
FIG. 9 is an enlarged bottom view showing the sole side of the toe section based on the development of FIG. 7.

In this example, with reference to FIG. 7, FIG. 8 and FIG. 9, there will be described an example of a sock for the Japanese "tabi" whose toe section is comprised of a big-toe bag (20) accommodating the big toe and a four-toe bag (30)

accommodating the other four toes. In this example, from the knitting end line (e1) of the tubular fabric (A), a trapezoidal big-toe sole fabric (B) having a width corresponding to the big toe is knitted.

This sole fabric (B) includes a wraparound portion (b) wrapping around to the instep side, thus protruding toward the instep side with a width greater than the width of the big toe.

And, knitting is effected from the knitting end line (e2) of this wraparound portion (b) to the knitting end line (e3) of the big-toe sole leading end fabric (C) for the big toe leading end (23).

The big toe instep leading end fabric (D) having the same, but vertically reversed, trapezoidal shape as the sole leading end fabric (C) is knitted from the knitting end line (e3) to a knitting end line (e4).

Then, from the knitting end line (e4), an instep fabric (E) having a parallelogram shape inclined toward the little toe side is knitted to the knitting end line (e5).

Of the end edges constituting the big-toe bag (20), the left and right circumferential edges (s3) and (s9) are reversal end edges of reciprocal knitting formed by alternatively increasing/decreasing one stitch for each course. Whereas, the other left and right circumferential edges (s4) to (s8) and (s10) are reversal end edges formed by alternatively increasing/decreasing one stitch for every several courses, thus having inclination angles relative to the centerline (X) gentler than those of the circumferential edges (s3), (s9).

As the wraparound portion (b) wraps around to the front side, the width of the base is made shorter. That is, it has become possible to reduce the width of the big-toe bag shorter than its length. With this arrangement, it has become possible to form the big-toe bag (20) narrower and longer.

This is for providing a bag longer and narrower in comparison with the width:length ratio of the conventional big-toe bag (20), thus making it more similar to the shape of the big toe.

Next, after reaching the knitting end line (e5), the ring-like fabric (F) is knitted and an arrangement is made such that the knitting start position of the fabric to be knitted next will not be restricted by the knitting end line (e5).

And, a sole fabric (B2) of the four-toe bag. (30) is knitted from the knitting end line (e6) of the ring-like fabric (F) to a knitting end line (e7) and in succession, the instep fabric (E2) having a reversed trapezoidal shape is knitted to a circumferential edge (s20).

In the course of the above, the circumferential edges (s16), (s18) were formed with adjustment of the relationship between the course number and the stitch number like the above such that these circumferential edges (s16), (s18) may have more gentle inclination angles relative to the centerline (X) than the circumferential edges (s17), (s19).

As a result, the portion covering the big-toe side lateral face of the second toe is formed with as moderate as possible inclination for alleviating pressurization of the toe end of the big-toe bag (30) or generation of excess of fabric on the side of the base.

And, with the above-described series of knitting process, the circumferential edges (s1) and (s11), (s2) and (s12), (s3) and (s11), (s4) and (s10), (s5) and (s7), (s6) and (s8), (s9) and (s11), (s16) and (s18) and (s17) and (s19) re joined respectively, thus forming join lines (s1-11), (s2-12), (s3-11), (s4-10), (s5-7), (s6-8), (s9-11), (s16-18), (s17-19), respectively.

And, the bag-like big-toe bag (20) and four-toe bag (30) are formed.

In the course of the above, an opening having opening edges (s13), (s13*a*), (s13*b*) and (s20) is formed between the four-toe bag (30) and the ring-like fabric (F), but (s13) and (s20), (s13*a*) and (s13*b*) are sewn and closed to each other respectively to form sewing lines (s13-20) and (s13*a-b*), whereby there was obtained a bag-like sock having the big-toe bag (20) and the four-toe bag (30) formed continuously at the leading end of the tubular foot section (1).

Also, with the wraparound portion (b) and the join lines (s5-7), (s4-10) and (s6-8) having the gentle inclinations, there was obtained the big-toe bag (20) having a longer length relative to the maximum width, in comparison with the conventional "tabi" sock, thus having a shape more similar to the shape of big toe.

As a result, even if the width of the leading end of the big toe bag (20) is formed larger than the convention, it is still possible not only to obtain snugly wearing feel, but also to cover the big toe base portion and its vicinity with the elasticity inherent in the knitted fabric, thus eliminating the unnatural feel on the body-center side of the big toe.

Moreover, in the four-toe bag (30) also, there occurs no hindrance to the snugness to the big-toe side lateral face of the long second toe, but the width of the leading end of the bag (30) is made greater to more suit the four toes in comparison with the convention, thus solving the various problems associated with excess of fabric at this portion.

Example 4

Figure 11:
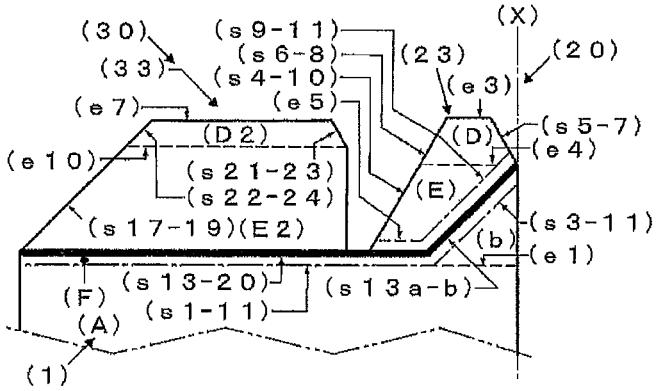
FIG. 11 is an enlarged plane view showing the instep side of the toe section based on the development of FIG. 10.
Figure 12:
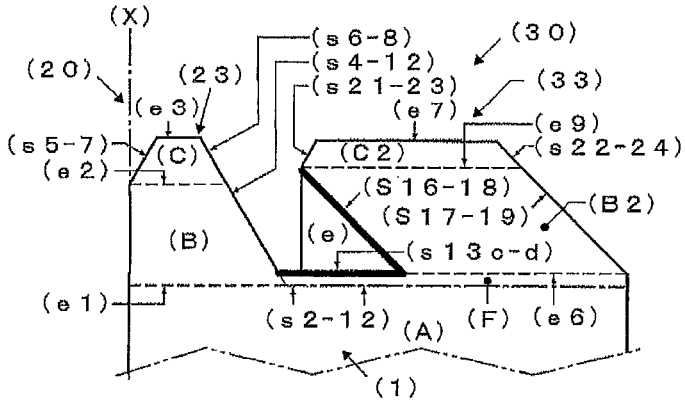
FIG. 12 is an enlarged bottom view showing the sole side of the toe section based on the development of FIG. 10.

In this example, with reference to FIG. 10, FIG. 11 and FIG. 12, there will be described an example wherein a wraparound portion is formed also at the four-toe bag (30) in the "tabi" sock disclosed in Example 3. In this example, the circumferential edges (s3) and (s5) correspond what is defined as the "end edge" in the context of the present invention.

Figure 10:
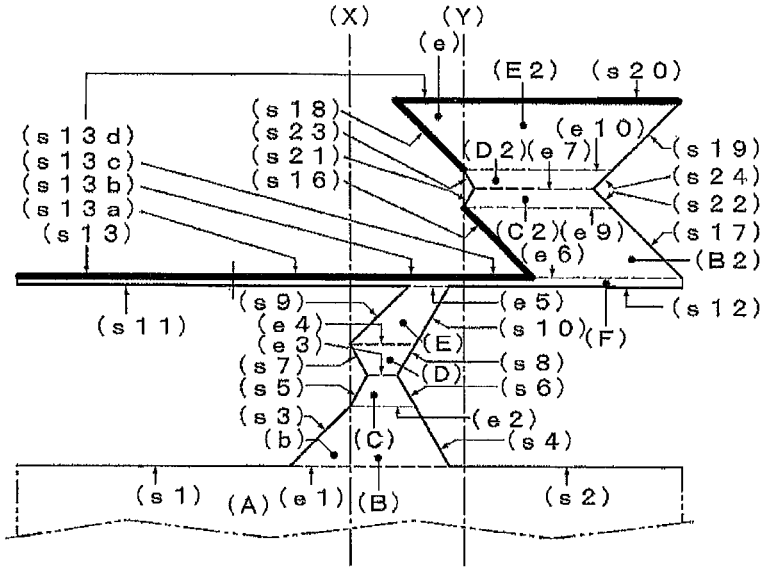
FIG. 10 is a development showing a toe section of a sock according to Example 4.

As shown in FIG. 10, on the big toe side of the instep fabric (E2) of the four-toe bag (30), a wraparound portion (e) wrapping around to the sole side is formed so that the second toe base portion and its vicinity of the four-toe bag (30) may be covered with the elasticity inherent in the knitted fabric.

More particularly, when the sole fabric (B2) is knitted from the ring-like fabric (F) to the knitting end line (e9), this is knitted as a fabric having an inclined parallelogram shape extending from a position on the little toe side relative to a centerline (Y) as the big-toe side tangent line of its second toe to this centerline (Y).

In succession, a trapezoidal sole leading end fabric (C2) for forming a leading end portion (33) of a four-toe bag (30) is knitted to the knitting end line (e7).

Further, from the knitting end line (e7), an instep side leading end fabric (D2) having the same, but vertically reversed shape as the sole side leading end fabric (B2) is knitted to a knitting end line (e10).

From the knitting end line (e10), the trapezoidal instep fabric (E2) having the wraparound portion (e) is knitted.

The shape of projection of the wraparound portion (e) from the centerline (Y) is same as the shape of space formed between the sole fabric (B2) and the centerline (Y).

During the above knitting, the big-toe side circumferential edges (s21) and (s23) of the fabrics (C2), (D2) constituting the leading end portion (33) and the circumferential edges (s21) and (s23), and (s22) and (s24), (s17) and (s19) located on the little toe side of the four-toe bag (30) are joined to each other, respectively, thus forming join lines (s21-23), (s22-24) and (s17-19).

Also, the circumferential edges (s13), (s13*a*), (s13*b*), (s13*c*), (s13*d*), (s16), (s18) and (s20) constitute the opening edges of the opening formed between the four-toe bag (30) and the ring-like fabric (F). Therefore, by sewing (s13) and (s20), (s13*a*) and (s13*b*), (s16) and (s18), (s13*c*) and (s13*d*), respectively, sewing lines (s13-20), (s13*a-b*), (s16-18) and (s13*c-d*) are formed respectively. And, with closing the opening, there was obtained a bag having no opening from the foot section (1) to the toe section (20), (30).

The rest of the construction is same as Example 3 described above, therefore, like references are provided and detailed explanation thereof will be omitted.

With the above-described arrangement, as the wraparound portion (e) wraps around from the instep side to the sole side of the four-toe bag (30), the wraparound portion is formed with an inclination such that its sewing line (s16-18) extends toward the little toe side as approaching the foot section (1). Also, as the sewing line (s13*c-d*) disposed on the foot section side of this wraparound portion (e) is located at a position in opposition to the foot arch (second arch) present on the sole side of the base of the four toes, it has become possible to substantially eliminate the possibility of this sewing line coming into contact with the toes.

As a result, at the big-toe side lateral face covering the second toe and its vicinity of the four-toe bag (30), a flexible intermediate portion, rather than a circumferential edge, of the fabric (B2) is located.

Rather, although the width of the four-toe bag (30) is decreased due to the wraparound portion (e), this decreased amount causes the fabric face to be aligned with the narrow and elongate big-toe side lateral face of the second toe, so that the snugness of the four-toe bag (30) to the toes is increased.

Consequently, it has become possible to eliminate or reduce the excess of fabric at the toe base of the four-toe bag (30) which would occur in the conventional "tabi" sock.

Example 5

Figure 13:
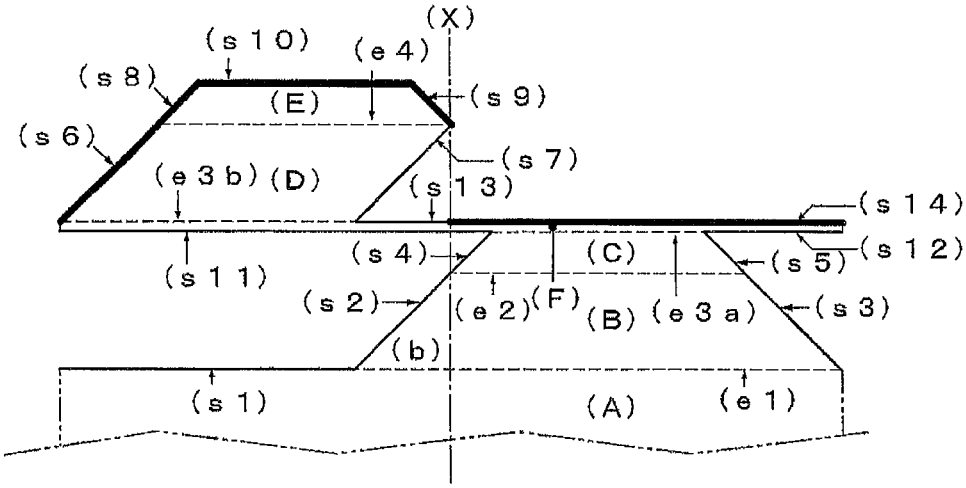
FIG. 13 is a development showing a toe section of a sock according to Example 5.
Figure 14:
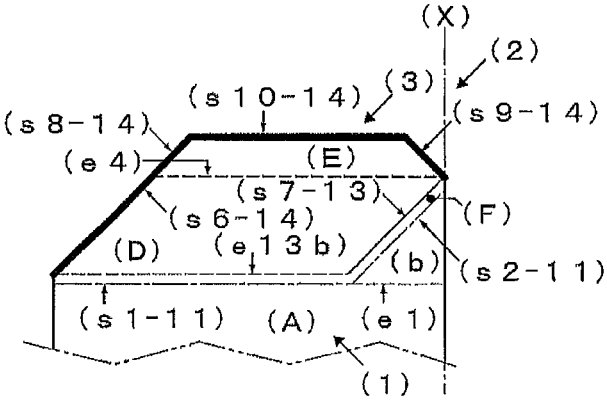
FIG. 14 is a plane view showing the instep side of the toe section based on the development of FIG. 13.
Figure 15:
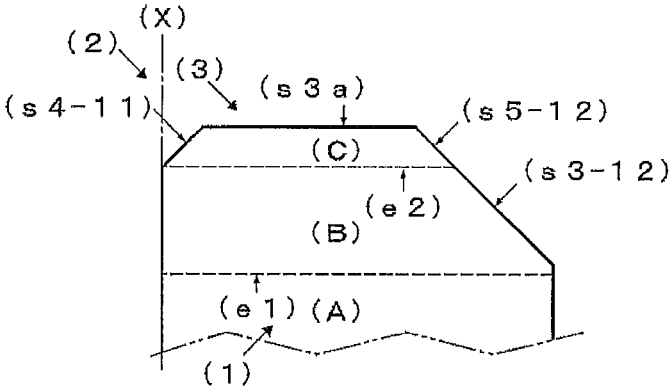
FIG. 15 is a bottom view showing the sole side of the toe section based on the development of FIG. 13.

In this example, with reference to FIG. 13, FIG. 14 and FIG. 15, there will be explained an example in which a sewing line is disposed at a circumferential edge of the toe section (2), in the Example 2 described above. In the instant example, the circumferential edges (s2) and (s4) correspond to what is defined as the "end edge" in the context of the present invention.

This is a portion where a toe is located and also where damage tends to occur due to contact with a sharp toe.

By locating, at this portion, a sewing line having a greater thickness than the original thickness of the knitted fabric by sewing, it can be expected that this portion retains a strength for resisting easy puncture thereof even if a damage occurs due to contact with a toe.

The wraparound portion (b) and the sole fabrics (B), (C) and the ring-like fabric (F) are same as those of Example 2, but the fabric construction of this example differs from Example 2 in that the instep side fabrics (D), (E) are left-to-right reversed and knitted more on the instep side than the centerline (X).

Like Example 2, after knitting is done to the ring-like fabric (F), on the instep side from the centerline (X), the parallelogram-shaped instep fabric (D) inclined toward the centerline (X) is knitted to the knitting end line (e4).

Then, in succession, the trapezoidal instep leading end fabric (E) is knitted.

Then, the instep side fabrics (D), (E) are knitted and the circumferential edges (s7), (s13) are joined.

And, although the opening having the opening edges (s6), (s8), (s10), (s9) and (s14) are formed between the ring-like fabric (F) and the instep side fabrics (D), (E), as this opening is closed by forming sewing lines (s6-14),(s8-14), (s10-14) and (s9-14). As a result, it was possible to form the toe section (2) in the form of a bag as a whole.

The rest of the construction is same as Example 2 described above, therefore, like references are provided and detailed explanation thereof will be omitted.

With the knitting arrangements described above, as shown in FIG. 14, the sewing lines (s6-14),(s8-14), (s10-14) and (s9-14) are all located at the toe leading end on the instep side and will be located at the portions coming into contact with the toe leading end when the sock is worn.

With this configuration, due to the use of the arrangement of interposing the ring-like fabric (F) between reciprocally knitted fabrics, these reciprocally knitted fabrics can be displaced freely relative to each other without adversely affecting each other.

Example 6

Figure 16:
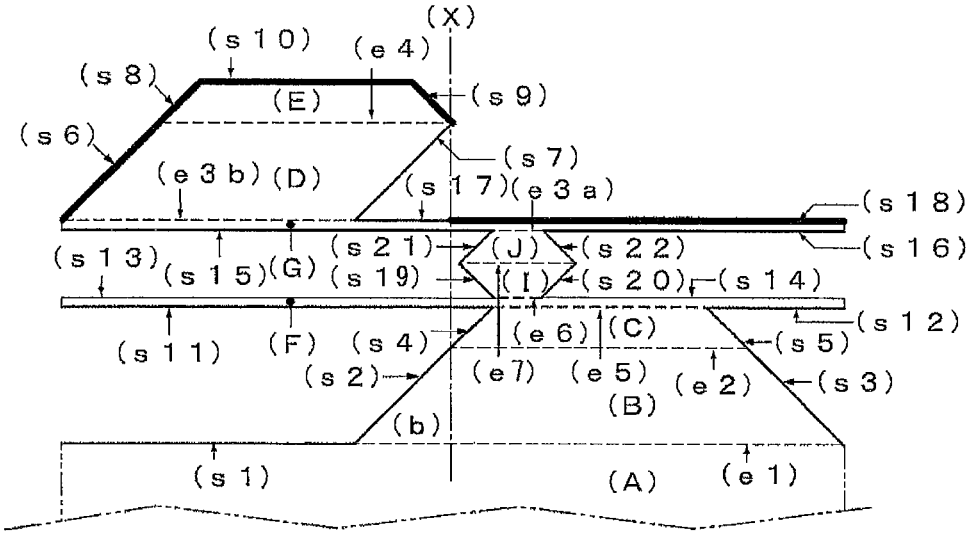
FIG. 16 is a development showing a toe section of a sock according to Example 6.
Figure 17:
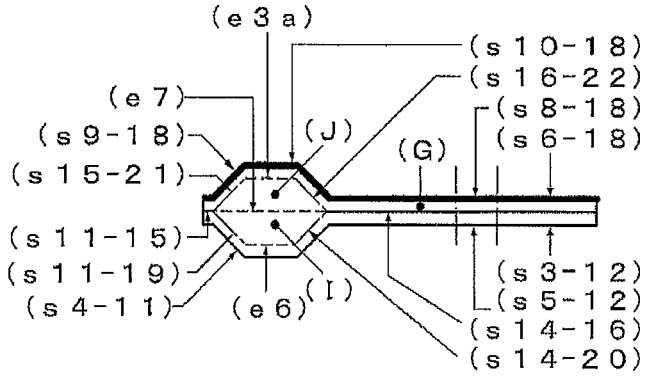
FIG. 17 is a front view of the toe section (the upper side in the figure is the instep side) based on the development of FIG. 16.

In this example, with reference to FIG. 16 and FIG. 17, there will be explained an example wherein the leading end face corresponding to the big toe is provided with an additional height so as to minimize pressurization to the big toe leading end, Example 5. In this example, the circumferential edges (s2) and (s4) correspond to what is defined as the "end edge" in the context of the present invention. Incidentally, this example can be applied not only to Example 2, but also to Examples 1, 3, 5.

After the sole leading end fabric (C) is knitted to the knitting end line (e5), the ring-like fabric (F) is knitted and trapezoidal fabrics (I) and (J) having the width corresponding to the big toe leading end face are knitted and then a ring-like fabric (G) is knitted.

The trapezoidal fabrics (I), (J) are reversed across the knitting end line (e7) and the left and right circumferential edges (s19) and (s21), (s20) and (s22) form V-shape; and as (s19) and (s13), (s21) and (s15), (s20) and (s14), (s22) and (s16) are joined to each other, thus forming a "gusset", which provides an additional height corresponding to the course to the big-toe leading of the toe section. Incidentally, the location of these trapezoidal fabrics (I), (J) is not limited to the one shown in the figures, as long as it is located at the toe leading end, and the location can be adjusted to the left or right within a range providing the expected effect. Further, with increase of the knitting width, it is possible to provide the toe section with a shape more suiting the toe shape.

The rest of the construction is same as Example 5 described above, therefore, like references are provided and detailed explanation thereof will be omitted.

Example 7

Figure 18:
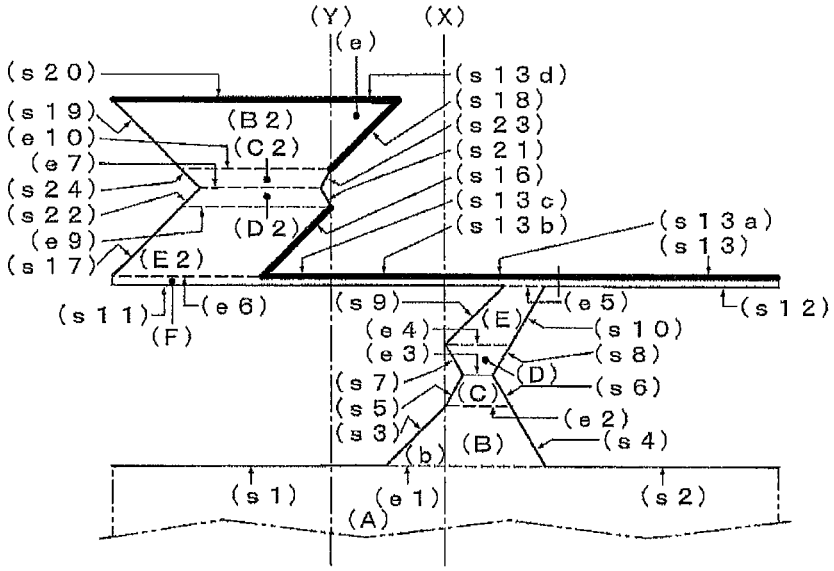
FIG. 18 is a development showing a toe section of a sock according to Example 7.
Figure 19:
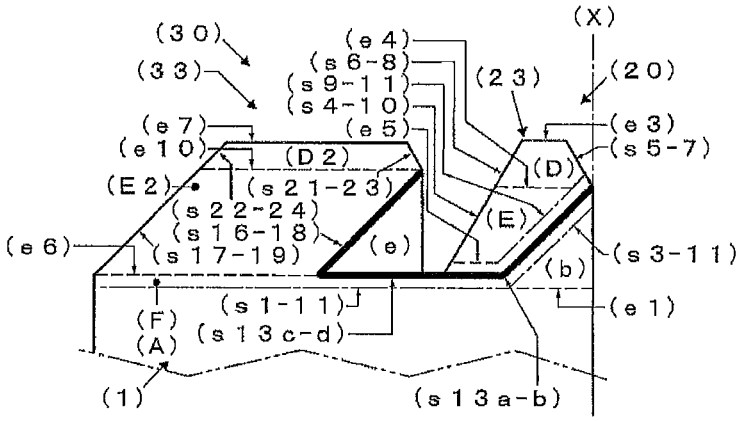
FIG. 19 is an enlarged plane view showing the instep side of the toe section based on the development of FIG. 18.
Figure 20:
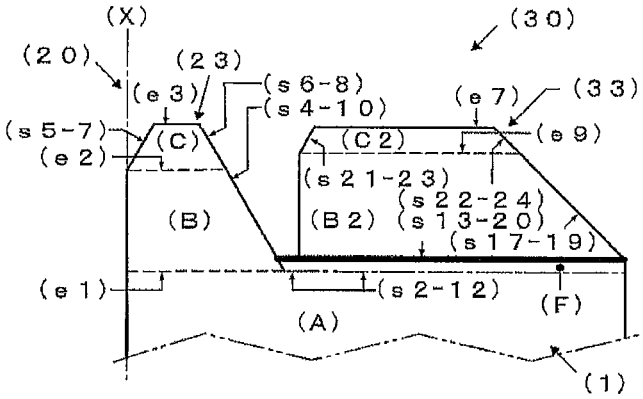
FIG. 20 is an enlarged plane view showing the sole side of the toe section based on the development of FIG. 18.

In this example, with reference to FIG. 18, FIG. 19 and FIG. 20, there will be explained an example wherein of the sewing lines provided in the "tabi" sock disclosed in Example 4, the sewing line of the wraparound portion (e) of the four-toe bag (30) is located on the instep side. In this example, the circumferential edges (s3) and (s5) correspond to what is defined as the "end edge" in the context of the present invention.

As a whole, the above-described object is achieved by right-to-left reversing the fabrics (B2), (C2), (D2), (E2)

constituting the four-toe bag (30) to be located on the instep side relative to the centerline (X).

After the ring-like fabric (F) is knitted, from the left side end in the figures, a parallelogram-shaped four-toe instep side fabric (E2) inclined toward the centerline (X) is knitted to the knitting end line (e9).

Then, after the trapezoidal instep side leading end fabric (D2) and then the vertically reversed sole leading end fabric (C2) are knitted, the reverse trapezoidal sole fabric (B2) is knitted.

This sole fabric (B2) has a wraparound portion (e) projecting beyond the centerline (Y) toward the centerline (X) and wrapping around toward the instep side.

In the course of knitting work described above, the circumferential edges (s17) and (s19), (s22) and (s24), (s21) and (s23) are joined to each other to form join lines (s17-19), (s22-24), (s21-23), respectively, thus forming a four-toe bag (30). and also, an opening having opening edges (s13), (s13*a*), (s13*b*), (s13*c*), (s16), (s18), (s13*d*) and (s20) is formed.

This opening is closed by sewing (s13) and (s20), (s13*a*) and (s13*b*), (s16) and (s18), (13*c*) and (s13*d*) respectively to form sewing lines (s13-20), (s13*a-b*), (s16-18) and (s13*c-d*), thus forming a bag as a whole.

In the sock thus obtained, (s13*a-b*), (s16-18) and (s13*c-d*) show on the instep side and the sewing line (s13-20) shows adjacent the base of the sole side.

The position of the presence of the sewing line (s13-20) is a portion that corresponds to the second arch adjacent the toe base and that is almost free from contact with the toe.

The rest of the construction is same as Example 4 described above, therefore, like references are provided and detailed explanation thereof will be omitted.

Example 8

Figure 21:
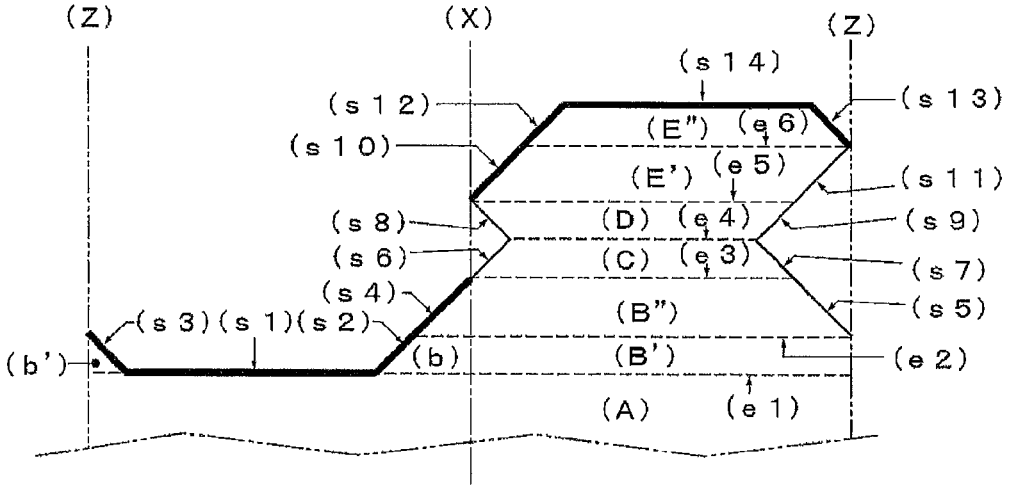
FIG. 21 is a development showing a toe section of a sock according to Example 8.
Figure 22:
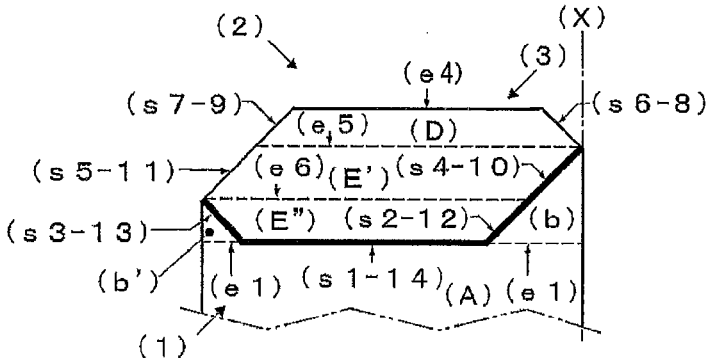
FIG. 22 is an enlarged plane view showing the instep side of the toe section based on the development of FIG. 21.
Figure 23:
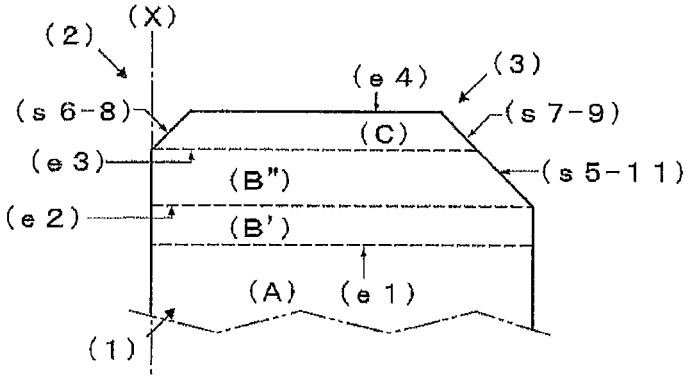
FIG. 23 is an enlarged plane view showing the sole side of the toe section based on the development of FIG. 21.

Next, with reference to FIG. 21, FIG. 22 and FIG. 23, there will be explained an example in which the left-to-right symmetric trapezoidal sole fabric (B) ((B')+(B") in the figures) in Example 1 is provided with wraparound portions (b), (b') for wrapping around toward the instep side. In this example, the circumferential edges (s2), (s4) and (s6) correspond to what is defined as the "end edge" in the context of the present invention.

After knitting of the tubular fabric (A) is completed, from its knitting end line (e1), the left-to-right symmetric trapezoidal sole fabric (B) is knitted by reciprocal knitting.

The sole fabric (B) is provided with the wraparound portions (b), (b') for wrapping around to the instep side. Therefore, knitting of the sole fabric (B) is started with a knitting width greater by the amount required for wraparound, beyond the centerline (X) and a sole fabric end line (Z). Then, knitting of the sole fabric (B) is ended at a position where its left side circumferential edge (s2) intersects the centerline (X) and the right side circumferential edge (s3) of the sole fabric (B) intersects the sole fabric end line (Z) and in succession, from its knitting end line (e2), the sole leading end fabric (C) having similar inclined trapezoidal shape is knitted to the knitting end line (e3).

Subsequently, from this knitting end line (e3), the instep leading end fabric (D) having vertically reversed trapezoidal shape from the sole leading end fabric (C) is knitted to the knitting end line (e4).

Further, from the knitting end line (e4), a trapezoidal instep fabric (E') is knitted, thus completing the knitting process.

In the course of the above-described knitting process, the left and right circumferential edges of the respective fabrics (s4) and (s6), (s5) and (s7) are joined to each respectively to form join lines (s4-6), (s5-7), whereby a bag-like toe section (2) is formed.

With the above-described knitting, the opening formed between the toe section (2) and the foot section (1) and having the opening edges formed by the circumferential edges (s1), (s2), (s3), (s8), (s9) and (s10) is closed by sewing (s1) and (s10), (s2) and (s8), (s3) and (s9) respectively to form sewing lines (s1-10), (s2-8) and (s3-9), whereby a closed sock is completed.

As described above, as shown in FIG. 21-FIG. 23, there has been obtained a sock wherein the base of the body-center side lateral face of the big toe and its vicinity as well as the little-toe side lateral face are covered by the knitted fabric having continuous wales formed by the wraparound portions (b), (b'), the tubular fabric (A) and the sole fabric (B), with absence of any circumferential edges of the fabric.

Absence of any join lines or sewing lines formed for the sake of integration with other fabric at the base of the body-center side lateral face of the big toe, the base of the little-toe side lateral face and their vicinity means that this sock is capable of covering these big and little portions with the flexibility inherent in the knitted fabric, thus not causing any abrasion damage which would occur conventionally due to reduction in the flexibility due to the presence of the join lines and sewing lines.

Example 9

Figure 25:
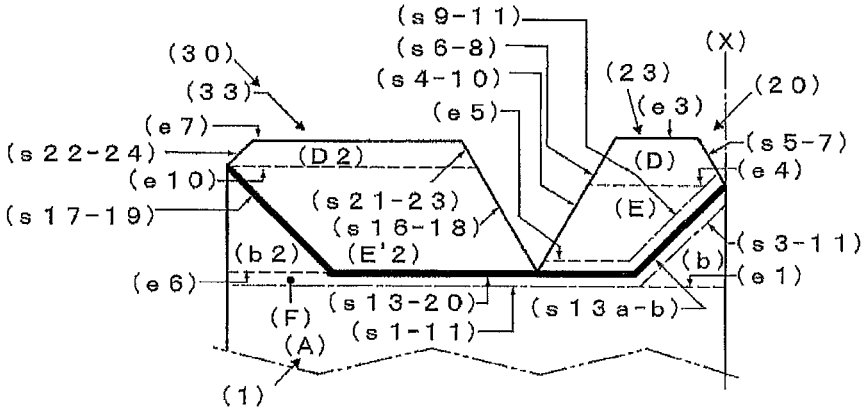
FIG. 25 is an enlarged plane view showing the instep side of the toe section based on the development of FIG. 24.
Figure 26:
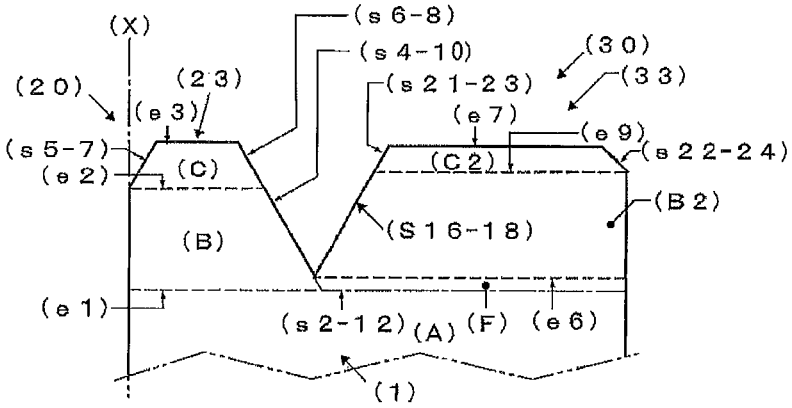
FIG. 26 is an enlarged plane view showing the sole side of the toe section based on the development of FIG. 24.

In this example, with reference to FIG. 24, FIG. 25 and FIG. 26, there will be explained an example wherein a wraparound portion is formed on the little toe side of the four-toe bag (30). In this example, the circumferential edges (s3) and (s5) correspond to what is defined as the "end edge" in the context of the present invention.

Figure 24:
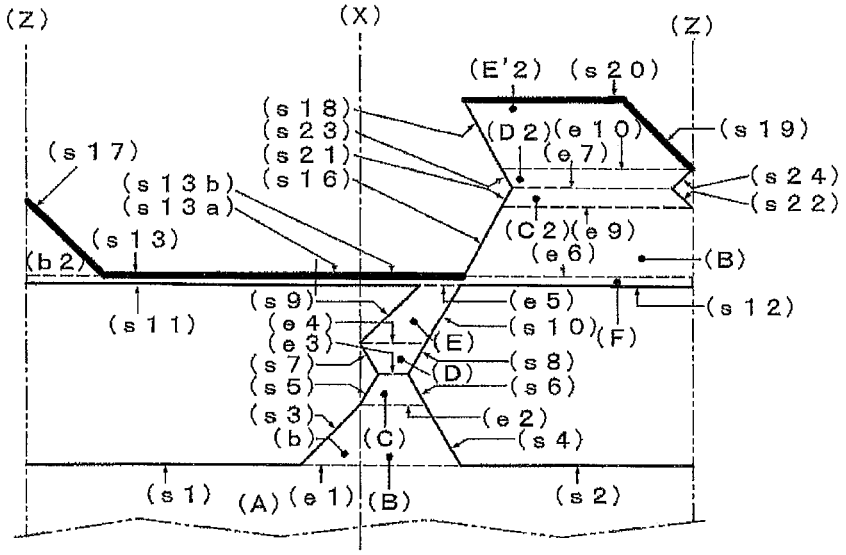
FIG. 24 is a development showing a toe section of a sock according to Example 9.

As shown in FIG. 24, the sole fabric (B2) for the four-toe bag (30) is provided with a wraparound portion (b2) for wrapping around to the instep side and is knitted with a knitting width greater by the amount required for wraparound, beyond the sole fabric end line (Z). Then, knitting of the sole fabric (B2) is ended to a knitting end line (e9), at a position where the circumferential edge (s17) on the right side of the knitting end line (e6) of the ring-like fabric (F) intersects the sole fabric end line (Z). In succession, (C2), (D2) for forming the leading end portion (33) of the four-toe bag (30) are knitted; and then, from a knitting end line (e10) of (D2), a parallelogram (E'2) inclined toward the big toe side is knitted.

In the course of the above knitting, the big-toe side circumferential edges (s21) and (s23), (s16) and (s18) of the fabrics (C2), (D2) constituting the leading end portion (33) and the little-toe side circumferential edges (s22) and (s24) of the four-toe bag (30) are joined to each other, respectively, thus forming join lines (s21-s23),(s17-19) and (s22-24).

Further, since the circumferential edges (s13), (s13*a*), (s13*b*), (s17), (s19) and (s20) constitute the opening edges of the opening formed between the four-toe bag (30) and the ring-like fabric (F), by sewing (s13) and (s20), (s13*a-b*), (s17) and (s19), respectively, sewing lines (s13-20), (s17-19) are formed and the opening is closed, whereby there was obtained a bag having no opening from the foot section (1) to the toe section (20), (30).

The rest of the construction is same as Example 5 described above, therefore, like references are provided and detailed explanation thereof will be omitted.

The wraparound portion (b2) wraps around from the instep portion toward the sole side of the four-toe bag (30) and its sewing line is formed with an inclination toward the big-toe side. With this, the effect described in Example 3 was obtained also on the little toe side of the four-toe bag, as well.

INDUSTRIAL APPLICABILITY

The present invention can be used for a sock wherein a foot section and a toe section are formed of knitted fabric and the toe section is provided with a predetermined bag-like shape by mutual joining of circumferential edges of the knitted fabric.

DESCRIPTION OF REFERENCE MARKS (1) foot section
(2) toe section
(3) leading end of the toe section
(20) big-toe bag
(23) leading end of the big-toe bag
(30) four-toe bag
(33) leading end of the four-toe bag
(A) tubular knitted fabric constituting the foot section
(B), (B2), (B'), (B"), (C), (C2), (D), (D2), (E), (E'), (E"), (E2), (E'2) knitted fabrics constituting the toe section
(F), (G), (H) ring-like fabrics
(I), (J) trapezoidal gusset fabric
(b), (b') wraparound portions of fabric (B), (b2) wraparound portion of the fabric (B2), (e) wrap around portion of fabric (E)
(e) wraparound portion of fabric (E)
(e0)-(e10) borderlines between two continuously knitted fabrics
(s1)-(s22) circumferential edges of the knitted fabric which are joined at the time of knitting, thin solid lines representing circumferential edge what are knitted by being joined during knitting, the bold solid lines representing circumferential edges that are sewn after knitting
(P1)-(P4), (Q1)-(Q4) end points
(sn-m) joining lines or sewing lines (n, m are portions of circumferential edges to be joined to each other).

The invention claimed is:

1. A sock including a foot section and a toe section both formed of knitted fabric, the toe section being provided in the form of a bag formed by mutual joining of circumferential edges of the knitted fabric;

wherein the toe section includes a stitch-number decreasing area where an area knitted by reciprocal knitting is progressively decreased, a stitch-number increasing area where an area knitted by reciprocal knitting is progressively increased, and a stitch-number constant area where an area knitted by reciprocal knitting is constant with a decrease on a first side offset by an increase on a second side opposite to the first side;

in the toe section, the stitch-number decreasing area is provided at a position adjacent the foot section;

the stitch-number decreasing area includes a sole fabric extending across and between a sole side and an instep side in the stitch-number decreasing area and a sole leading end fabric, adjacent to the sole fabric, is provided only on the sole side of the stitch-number decreasing area;

the stitch-number increasing area is provided only on the sole side and is a top leading end fabric adjacent to the sole leading end fabric;

the stitch-number constant area is provided only on the sole side and is an instep fabric adjacent to the top leading end fabric:

a lateral dividing line is provided which divides between the instep side and the sole side of the knitted fabric, wherein the lateral dividing line represents a centerline of a portion of the sock for covering a big toe, the centerline being in contact with a body-center side lateral face;

an end edge line of a wraparound portion of the sole fabric is wrapping around to the instep side and an end edge line of the sole leading end fabric is located on the opposite side of the end edge line of the wraparound portion relative to the lateral dividing line; and a knitted portion of the fabric is present at a portion for covering a lateral face of a vicinity of a base of a toe section.

2. The sock according to claim 1, wherein a big-toe side end edge of the fabric covering one of a sole portion and an instep portion of the toe section extends into the other of the sole portion and the instep portion of the toe section on the side of the toe base side, and a big-toe side join line joining these two portions is located on the other of the sole portion and the instep portion.

3. The sock according to claim 1, wherein the toe section consists of a big toe bag accommodating the big toe and a four-toe bag accommodating the other toes, and the big-toe bag includes a knitted portion of a knitted fabric at a portion thereof for covering a base of the body-center side lateral face of the big toe.

4. The sock according to claim 3, wherein a body-center side lateral end edge of the fabric covering one of a sole portion and an instep portion of the big-toe bag extends into the other of the sole portion and the instep portion of the big-toe bag on the side of the toe base side, and a big-toe side join line joining these two portions is located on the other of the sole portion and the instep portion.

* * * * *